United States Patent [19]

Sumrow

[11] 4,101,609

[45] Jul. 18, 1978

[54] COVER HOLDER FOR EVAPORATIVE COOLER

[76] Inventor: Paul E. Sumrow, 45115 N. Redwood Ave., Lancaster, Calif. 93534

[21] Appl. No.: 730,273

[22] Filed: Oct. 5, 1976

[51] Int. Cl.[2] ..... B01F 3/04

[52] U.S. Cl. ..... 261/105; 49/63; 52/499; 261/106; 261/DIG. 41; 312/292

[58] Field of Search ..... 261/1, 100–107, 261/24, DIG. 3, DIG. 4, DIG. 41, DIG. 43, DIG. 11, DIG. 15; 49/63, 70, 463; 248/201, 301, 244, 477, 488, 748, 224.3; 16/90; 52/261, 282, 499; 312/257 A, 257 SK, 138 R, 138 A, 292; 55/493

[56] References Cited

U.S. PATENT DOCUMENTS

| | | | |
|---|---|---|---|
| 1,927,398 | 9/1933 | Glasser | 312/138 A |
| 2,150,064 | 3/1939 | John et al. | 312/292 |
| 2,409,078 | 10/1946 | Swann | 55/493 X |
| 2,680,603 | 6/1954 | Taylor | 261/24 X |
| 2,988,315 | 6/1961 | Saxe | 211/87 X |
| 3,035,670 | 5/1962 | Whyte | 49/463 |
| 3,071,218 | 1/1963 | Goettl et al. | 52/499 X |
| 3,075,750 | 1/1963 | Goettl | 261/DIG. 41 |
| 3,105,860 | 10/1963 | Dunn | 261/103 X |
| 3,150,945 | 9/1964 | Baggeson | 261/DIG. 41 |
| 3,380,192 | 4/1968 | McKenna | 49/463 X |
| 3,400,919 | 9/1968 | Schall | 261/102 |
| 3,636,661 | 1/1972 | Strawsine | 49/463 X |
| 3,802,493 | 4/1974 | Goettl | 261/105 X |

*Primary Examiner*—Richard L. Chiesa

*Attorney, Agent, or Firm*—Clarence A. O'Brien; Harvey B. Jacobson

[57] ABSTRACT

A cover for an evaporative cooler has a substantially planar cover member selectively arrangeable for blocking access to the pad of the cooler and protecting the pad from the elements when the pad is not in use. A suitable holder retains the cover member on the cooler so as to cover an associated opening provided in the main frame of the cooler for receiving the cooler pad.

1 Claim, 13 Drawing Figures

COVER HOLDER FOR EVAPORATIVE COOLER

BACKGROUND OF THE INVENTION

1. Field of the Invention

This invention relates generally to evaporative coolers, and particularly to arrangements for covering or blocking the opening conventionally provided in the main frame of an evaporative cooler so as to protect a cooling pad associated with the opening when the cooler is not in use.

2. Description of the Prior Art

Evaporative coolers such as employed in many arid parts of the world commonly include a main frame provided with a plurality of openings in the sides thereof, and each of the openings provided with a pad constructed from a fibrous material. Water is run across the plane of the pad while warm-dry air is passed through the pad. The warm air evaporates the liquid in the pad with a resultant drop in temperature and increase in humidity of the air which effectively conditions the air for distribution into the room of a residence or other structure.

A difficulty that arises with the use of such coolers is that it is generally advisable to cover at least the portions of the main frame in which the pad-receiving openings are provided with the cooler is not being used. Conventionally, these openings are covered by covers constructed from canvas, polymeric resins, and other suitable flexible materials.

An alternative to the use of a cover over the cooler is to remove the pads from the cooler when the latter is not being used, such as in the winter months, but this approach exposes the interior of the cooler to the ravages of the elements, and usually creates a substantial amount of maintenance and repair before the cooler can be activated again.

U.S. Pat. No. 3,071,218, issued Jan. 1, 1963 to A. D. Goettl et al, discloses an example of an evaporative cooler of the kind wherein the pads are supported by a pad frame hingedly mounted on the main frame of the cooler.

It is generally known to use guide flanges and similar elements to mount an element on a supporting member, examples of which can be found in U.S. Pat. No. 3,237,898, issued Mar. 1, 1966 to J. W. Goss, and U.S. Pt. No. 2,987,832, issued June 13, 1961 to L. F. Urbain et al. Further, it is known to use such guides in conjunction with members employed to block or cover varying kinds of structures, and examples of this application of slide guides can be found in U.S. Pat. No. 527,792, issued Oct. 23, 1894 to E. A.Hill; U.S. Pat. No. 817,015, issued Apr. 3, 1906 to O. M. Stimson; and U.S. Pat. 3,861,081, issued Jan. 21, 1975 to J. A. Robertson.

SUMMARY OF THE INVENTION

It is an object of the present invention to provide a cover system for evaporative coolers which will withstand the elements better than covers commonly used for this purpose.

It is another object of the present invention to provide a more rigid and enduring cover for evaporative coolers than the flexible covers conventionally employed for protecting the cooler when same is not being used.

It is yet another object of the present invention to provide a cover system for evaporative coolers which can be used with either existing or newly constructed coolers.

These and other objects are achieved according to the present invention by providing a cover having: a cover member arranged for selectively blocking a pad of an evaporative coolers; and a holder associated with the evaporative coolers and with the cover member for retaining the cover member on the cooler.

While the cover member may be a sheet of fluid impervious material, one preferred embodiment of the invention associates the cover member with a pad frame which holds the cooler pad in an associated opening of the main frame of the cooler. In this embodiment, the cover member can be hingedly mounted on the main frame of the cooler and provided with louvers mounted on the cover member and arranged for movement between an open position permitting fluid flow through the cover member and a closed position blocking fluid flow through the cover member so that the cooler pad may be protected when the cooler is not in use merely by moving the louvers to their closed position.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
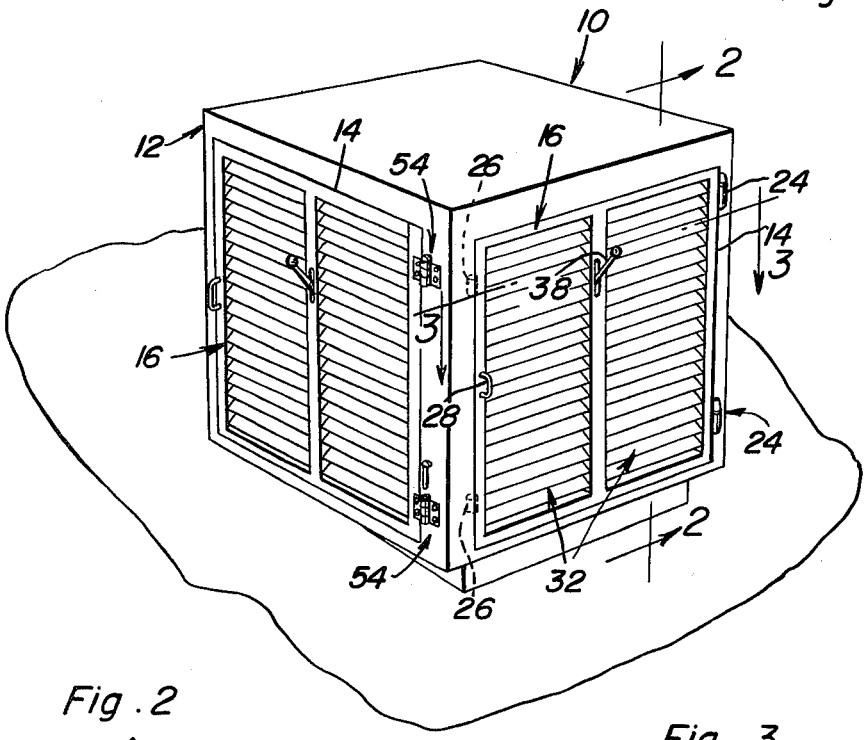
FIG. 1 is a fragmentary, perspective view showing an evaporative cooler provided with covers according to the present invention mounted on the roof of a structure.
Figure 2:
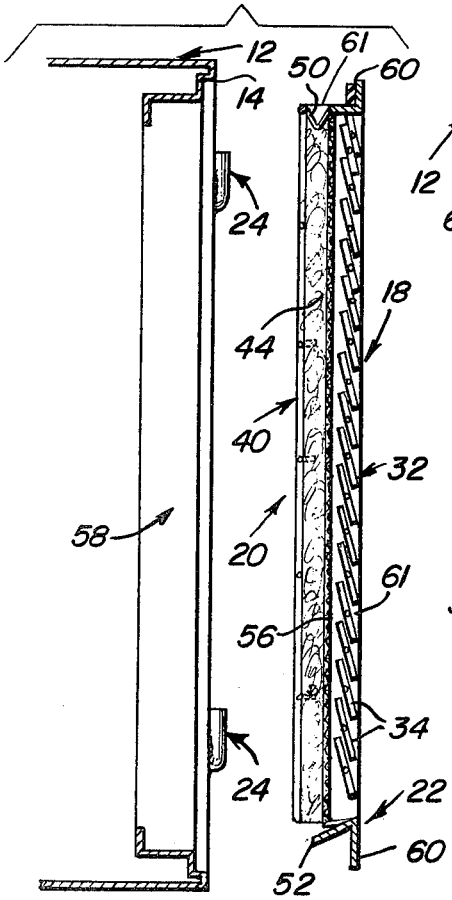
FIG. 2 is an enlarged, fragmentary, exploded sectional view taken generally along the line 2—2 of FIG. 1.
Figure 3:
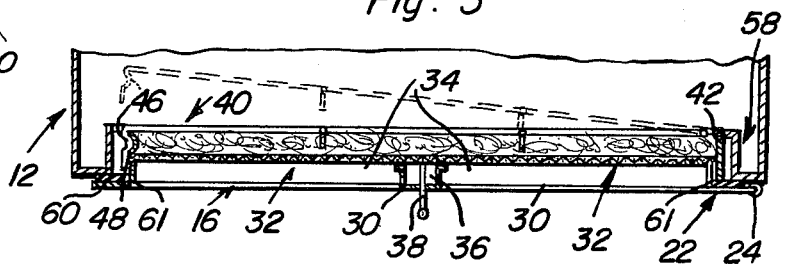
FIG. 3 is an enlarged, fragmentary, sectional view taken generally along the line 3—3 of FIG. 1.
Figure 4:
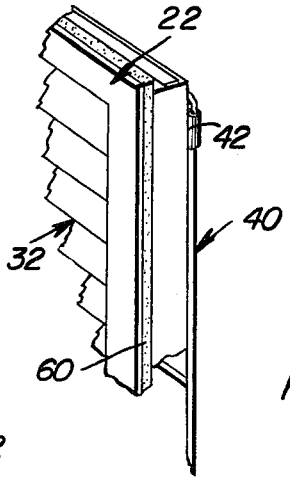
FIG. 4 is a fragmentary, perspective view showing a detail of the upper right-hand corner of the arrangement shown in FIG. 1.
Figure 5:
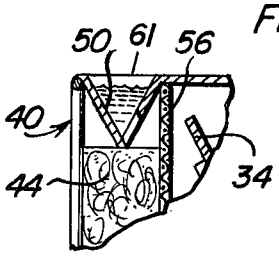
FIG. 5 is an enlarged, fragmentary, detailed view of the upper right-hand portion of FIG. 2.
Figure 6:
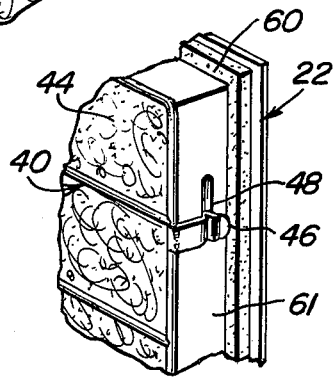
FIG. 6 is a fragmentary, perspective view showing a detail looking from the rear of the left-hand side of FIG. 3.

Referring now more particularly to the embodiment of the invention shown in FIGS. 1–6 of the drawings, an evaporative cooler 10 of conventional construction includes a main frame 12 provided with a plurality of openings 14 disposed on the side surfaces of frame 12 for receiving a conventional cooler pad. Over these openings 14 so as to effectively block same are disposed covers 16. In this embodiment of the invention, the covers 16 are provided with louvers which can be selectively opened and closed in order to block and unblock fluid flow through the associated covers 16.

Each cover 16 includes a cover member 18 arranged for selectively blocking the pad-receiving opening 14 of the main frame 12, together with a holder 20 associated with both the frame 12 and cover member 18 for retaining cover member 18 on the cooler 10.

More specifically, in the embodiment shown in FIGS. 1–6, cover member 18 includes a support element 22 which essentially is the frame of cover member 18, and is hingedly mounted on main frame 12 as by conventional hinges 24 so as to be disposed within an associated one of the openings 14 and be able to swing open so as to permit access to the interior of main frame 12 and to the back side of the support element 22. The latter may be retained in the closed position shown in FIGS. 1 and 3 by means of suitable magnetic latches 26, and the like, and can be pulled open so as to disengage latches 26 by means of a handle 28.

A pair of windows 30 are shown as provided in support element 22 in which windows are disposed louvers 32. Each of these louvers 32 includes a plurality of pivotally mounted slats 34, arranged for movement about a horizontal axis and connected to a bar 36 on which is mounted a handle 38 which extends through a slot provided in support element 22. As will be appreciated, manipulation of handle 38 along the length of its associated slot will cause longitudinal movement of bar 36 and, accordingly, pivotal movement of the slats 34 in a manner known per se in order to open and close the louvers 32 and move the cover member 18 between an open position permitting fluid flow therethrough and a closed position blocking fluid flow through cover member 18 so as to protect the pads and interior of the cooler 10 which would otherwise be exposed by the openings 14.

Mounted on support element 22 is a pad rack or frame 40 of open wire construction and including side portions extending perpendicularly away from the plane of cover member 18, and a back portion hingedly mounted on one side of the side portions as by hinges 42 formed by a cantilever mounted sleeve and cooperating wire pin, only one of which hinge 42 is shown for simplicity, and retaining a conventional cooler pad 44 against the back surface of cover member 18 as by a spring latch 46 and cooperating keeper 48 attached to the back portion of cover member 18. By this arrangement, the cover member 18 forms a panel for main frame 12 of cooler 10, with the louvers 32 selectively opening and closing access to the pad 44.

An advantage of the hinged pad frame 40 is that when cover 16 is open, the frame 40 can be opened and a pad 44 installed without removing the cover 16 from the cooler. Also, frame 40 can be easily removed from cover 16 if necessary by lifting frame 40 up and out of the tube-type hinges 42.

A V-shaped trough 50 is disposed along the upper portion of pad 44 and is provided with a plurality of apertures for permitting water to trickle down through pad 44 along the plane thereof and pass into a sheet 52 disposed beneath pad 44 and slanted downwardly toward the interior of frame 12. As can be seen from FIG. 2, trough 50 and sheet 52 are advantageously mounted on support element 22 and extend along the top and bottom, respectively, of cover member 18 to act as top and bottom frames for pad 44. Water from sheet 52 will run into a cooler pad (not shown), thus being eliminated from running back toward the cover, while a hose (not shown) and the like can be placed in communication with trough 50 for supplying water, or other suitable liquid, to the trough 50.

While hinges 24 are generally adequate to mount the cover 16, in close quarters, they do not permit the cover to be removed unless it is swung part way open or the hinge unscrewed from the frame. Accordingly, a cover 16 can be hung by conventional leaf and removable pintle hinges 54 which permit removal of the cover by pulling the pintle or pin out of the hinge and lifting the side out.

A piece of screen 56 is advantageously disposed between the louvers 32 and cooler pad 44 for spacing pad 44 from the shutters, while a jamb 58 is arranged in opening 14 of the main frame 12 to frame pad 44 on all four sides in order to protectively receive the pad frame 40 and have the side member thereof cooperate with trough 50 and sheet 52. A suitable seal 60 is advantageously disposed extending around the peripheral flange portion 61 of the support element 22 at the inner surface thereof in order to provide a seal between cover member 18 and jamb 58. Further, when closed, the cover member 18 will be flush with the associated surface of main frame 12.

It is to be understood that a cover provided with fixed louvers (not shown) also can be hung from the cooler frame by hinges in the manner described above so as to permit swinging movement of the cover.

Figure 7:
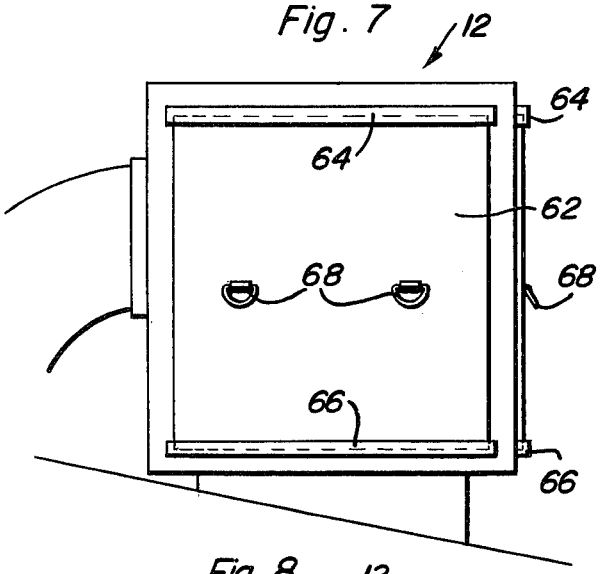
FIG. 7 is a schematic, side elevational view showing another embodiment of the present invention.
Figure 8:
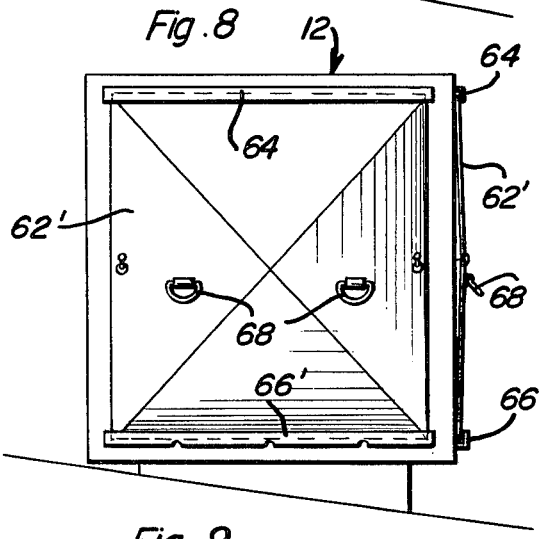
FIG. 8 is a schematic, side elevational view, similar to FIG. 7, but showing yet another embodiment of the present invention.

Referring now more particularly to FIGS. 7 and 8 of the drawings, cover members designated 62 and 62' are shown therein which are constructed from a sheet of impervious material, such as a suitable metal, and are retained on a main frame 12 of an evaporative cooler as by the illustrated horizontally disposed pair of opposed longitudinally extending slide guides 64 and 66 affixed to main frame 12 and arranged for slidably receiving peripheral portions of the associated sheet 62, 62'. As can be seen from FIGS. 7 and 8, sheets 62 and 62' differ only in that sheet 62 is substantially planar while sheet 62' is slightly crowned. Both the sheets 62 and 62' are provided with one or more handles 68 to facilitate placement in and removal from the slide guides 64 and 66, which guides 64 and 66 are generally in the form of angle structural members.

Figure 9:
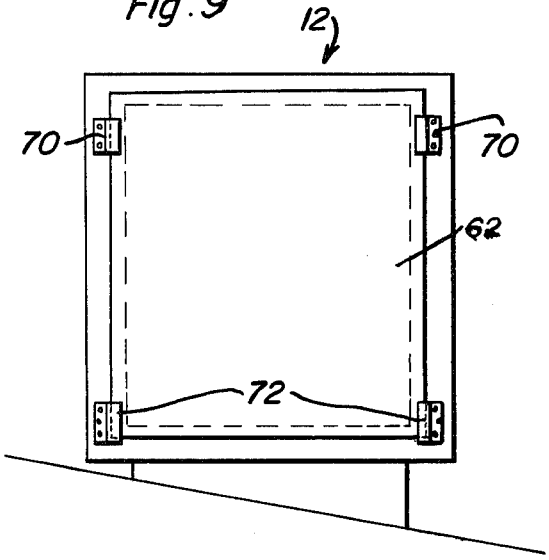
FIG. 9 is a schematic, side elevational view, similar to FIGS. 7 and 8, but showing a fourth embodiment of the invention.
Figure 10:
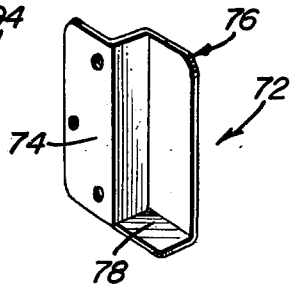
FIG. 10 is a perspective view showing a detail of the embodiment of the invention seen in FIG. 9.
Figure 1:
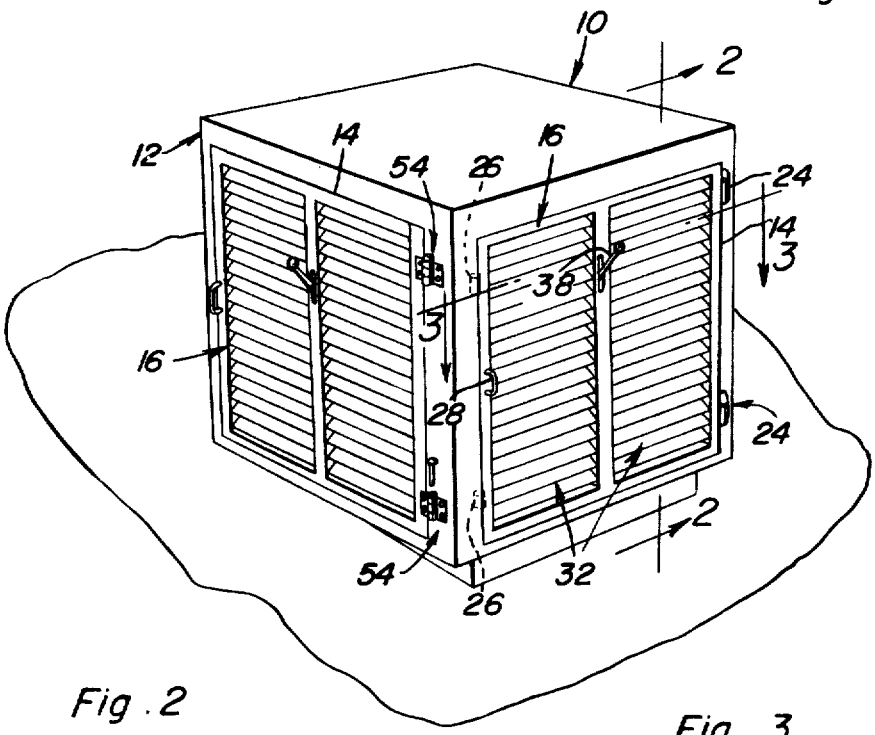
Figure 2:
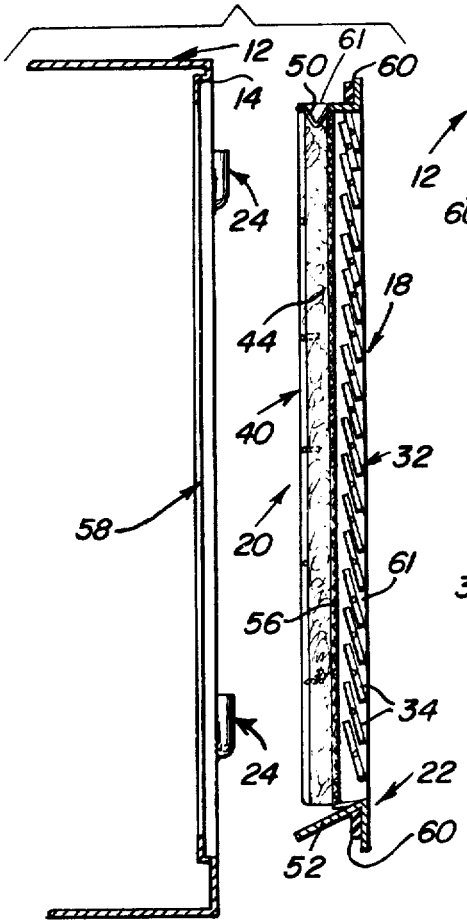
Figure 3:
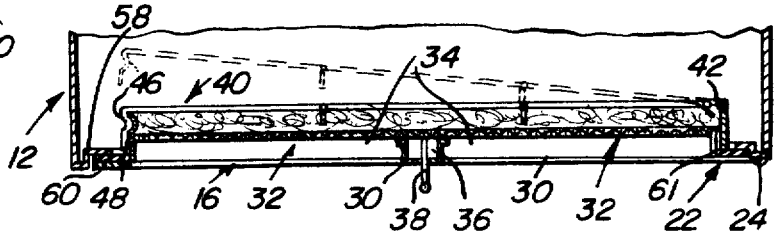
Figure 4:
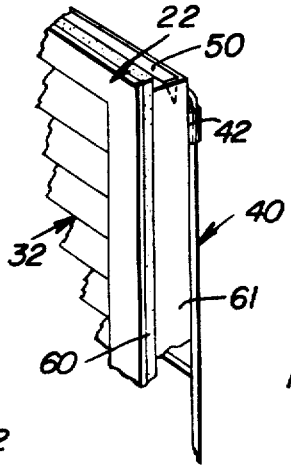
Figure 5:
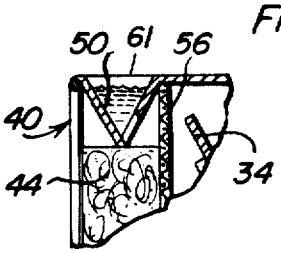
Figure 6:
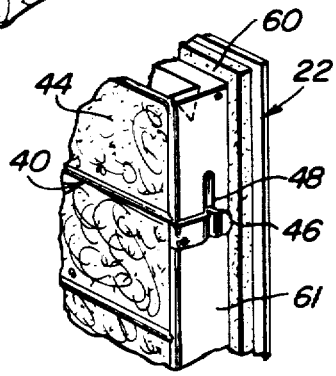

FIGS. 9 and 10 show yet another embodiment of the invention where a sheet 62, or sheet 62' (not shown), is retained on a main frame 12 as by individual brackets 70 and 72 disposed for permitting vertical sliding movement of the sheet 62. Brackets 72 are similar in that both include a plate portion 74 provided with a plurality of apertures facilitating attachment of the associated bracket to main frame 12, and an angle portion 76 extending from the plate portion 74 for providing a pocket which receives a peripheral portion of an associated sheet 62. The bracket 72 differs from bracket 70 in that it is provided with a bottom 78 associated with the angle portion 76 for limiting downward movement of sheet 62 within the brackets 70 and 72.

Figure 11:
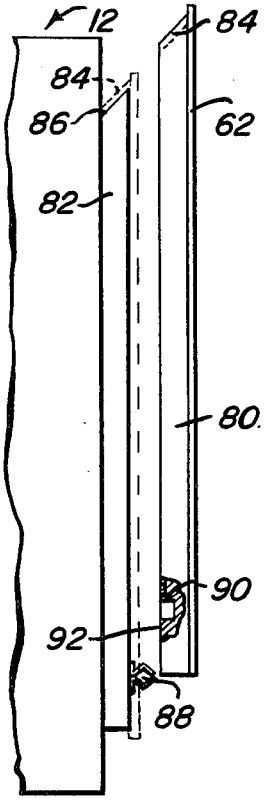
FIG. 11 is a fragmentary, schematic, side elevational view showing yet another embodiment of an evaporative cooler cover according to the present invention.

Yet another embodiment of the invention is shown in FIG. 11, wherein a cover member in the form of the substantially planar sheet 62 is provided with a framework 80 forming a socket projecting from the rear surface of sheet 62 and selectively receiving the frame 82 projecting outwardly from main frame 12 about an associated one of the openings 14. An inclined ledge 84 is provided on the top of edge of framework 80 for mating with a similarly inclined surface 86 provided at the top portion of frame 82 and retain the sheet 62 on the frame 82, while a spring catch 88 is provided at the lower portion of frame 82 for engaging an aperture 90 provided in an edge 92 of framework 80 in order to securely retain the framework 80 on frame 82.

Figure 12:
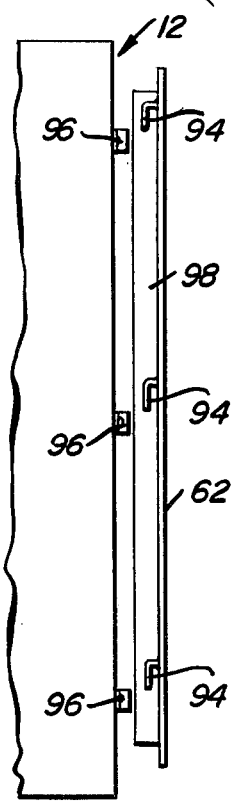
FIG. 12 is a fragmentary, schematic, side elevational view, similar to FIG. 11, but showing still another embodiment of the invention.

Referring now to FIG. 12, another embodiment of the invention employs a plurality of right-angle projections 94 having a leg extending downwardly and spaced from the plane of a cover sheet 62 in order to engage with sleeves 96 mounted on main frame 12. Thus, simple up and down motion of the sheet 62 over a relatively short distance will cause engagement and disengagement of the projections 94 in the sleeves 96 and retain cover 62 on the main frame 12. A shroud 98 is advantageously provided on the back surface of sheet 62 in order to provide abutment of the cover member with the outer surface of main frame 12.

Figure 13:
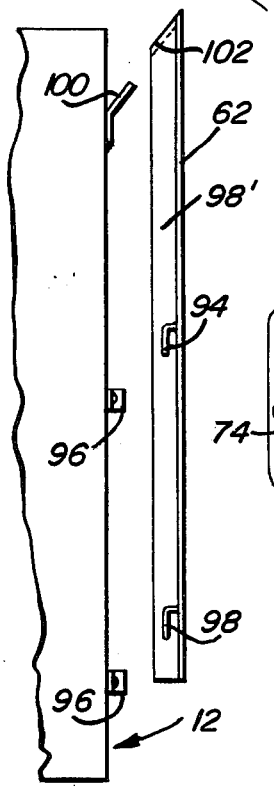
FIG. 13 is a fragmentary, schematic, side elevational view, similar to FIGS. 11 and 12, but showing a still further embodiment of an evaporative cooler cover according to the present invention.

Another embodiment of the invention as seen in FIG. 13 is similar to that shown in FIG. 12, except that a projection 100 extends from the upper portion of main frame 12 at an acute angle with respect thereto and engages with the undersurface of a ledge 102 formed at the top of a shroud 98 extending from the back portion of sheet 62 so as to provide continuous contact of the cover member with the associated face of the main frame 12.

As can be appreciated from the above description and from the drawings, an evaporative cooler, according to the present invention, provides a rugged and reliable, yet inexpensive and easy to install protective device for conventional evaporative coolers, and can even be used with existing coolers as well as those being newly constructed. As seen in FIG. 8, the bottom guide 66' of the arrangement employing a pair of upper and lower horizontally disposed guides can be provided with a plurality of apertures in order to permit rain water, and the like, to drain from the guide and not be trapped therein.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A cover for an evaporative cooler, comprising, in combination:

(a) a cover member hingedly mounted on an open side of an evaporative cooler; and (b) holder means associated with the evaporative cooler and with the cover member for hingedly mounted the cover member on the cooler for swinging movement with respect to the cooler, the holder means including a pad frame hingedly mounted on the cover member, an evaporative cooler pad arranged between the pad frame and the door, the cover member forming a swinging door panel for a main frame of the evaporative cooler, the pad frame and door panel being hingedly mounted adjacent one another for swinging movement away from one another about separate, but adjacent, parallel axes, the pad frame including a spring latch mounted on the pad frame at a point spaced from the axis of hingedly mounting of the pad frame the extent of the pad frame, and keeper means being provided on the holding means for engaging with the latch retaining the pad frame substantially parallel to the door panel, the cover member including a support element, a louver mounted on the support element and arranged for movement between an open position permitting fluid to flow through the cover member and a closed position blocking fluid flow through the cover member.

* * * * *

UNITED STATES PATENT AND TRADEMARK OFFICE

CERTIFICATE OF CORRECTION

PATENT NO. 4,101,609

DATED July 18, 1978

INVENTOR(S) :Paul E. Sumrow

It is certified that error appears in the above–identified patent and that said Letters Patent are hereby corrected as shown below:

Column 1, line 27, cancel "with" insert --when--; line 48, cancel "Pt." insert --Pat.--.

Column 2, line 6, cancel "coolers" insert --cooler--; line 7, cancel "coolers" insert --cooler--.

Column 4, line 4, cancel "into" insert --onto--; line 11, cancel "pad" insert --pan--; line 61, after "Brackets" insert --70 and--.

Column 6, line 21, cancel "mounted" insert --mounting--; line 26, cancel "door" insert --cover member--; line 35, cancel "holding" insert --holder--. Sheet 1 of the drawings should be deleted to insert the attached sheet therefor.

Signed and Sealed this

*First* Day of *July 1980*

[SEAL]

*Attest:*

SIDNEY A. DIAMOND

*Attesting Officer*

*Commissioner of Patents and Trademarks*